United States Patent [19]

Berggren

[11] 4,303,272

[45] Dec. 1, 1981

[54] CHILDREN'S HIGHCHAIR EQUIPPED WITH PLAY AND FOOD TRAY

[75] Inventor: Tony Berggren, Skillinge, Sweden

[73] Assignee: Ifo Sanitar Aktiebolag Simrishamnsfabriken, Sweden

[21] Appl. No.: 128,944

[22] Filed: Mar. 10, 1980

[51] Int. Cl.[3] ..... A47C 7/68

[52] U.S. Cl. ..... 297/153; 297/467

[58] Field of Search ..... 297/487, 488, 153, 174, 297/170, 467

[56] References Cited

U.S. PATENT DOCUMENTS

| | | | |
|---|---|---|---|
| 485,382 | 11/1892 | Hemmer | 297/153 |
| 3,490,808 | 1/1970 | Siegel | 297/153 |
| 3,682,521 | 8/1972 | Kesling | 297/153 |

FOREIGN PATENT DOCUMENTS

| | | | |
|---|---|---|---|
| 1348536 | 12/1963 | France | 297/153 |
| 2006617 | 5/1979 | United Kingdom | 297/487 |

OTHER PUBLICATIONS

Swedish Design Registration No. 12965, Jul. 1973.

*Primary Examiner*—James T. McCall

*Attorney, Agent, or Firm*—Brumbaugh, Graves, Donohue & Raymond

[57] ABSTRACT

A children's highchair equipped with a removable play and food tray that is readily attachable and detachable from the chair. At forward arm sections of the chair a bar extending between the arm supports fits into a recess on a rearward edge of the tray. The bar serves as a forward child restraint, with or without the tray in place. Shafts extend rearward from the tray, and projections on the shaft fit into aligning holes in the highchair sides to forms, with the holes, locking means attaching the tray to the chair. The tray is pivotal about the bar that secures it in place at the forward end of the arm support sections and the projections on the shafts have latching bosses on their ends that latch about the inside edges of the cooperating holes when slight downward pressure is applied on the play and food surface of the tray.

6 Claims, 4 Drawing Figures

CHILDREN'S HIGHCHAIR EQUIPPED WITH PLAY AND FOOD TRAY

BACKGROUND OF THE INVENTION

This invention relates to a children's highchair which is equipped with a removable play and food tray and which is designed to facilitate the attachment and detachment of the tray. More particularly, the invention relates to a highchair in which the detachable tray fits securely and safely onto the chair and does not constitute a danger to the child.

Highchairs equipped with fixed play or food trays are known, as are highchairs with fold-up and/or detachable trays. In both cases, however, the trays are mounted in position by means of screw connections or employ a rotating locking device. This prevents the tray from being easily released, with a resultant risk of injury to the child. Furthermore, other known highchairs employ the play and food tray as the only forward restraint on the child, and thus, accidental release of the tray can result in the child's falling from the chair. In addition, if this kind of chair is used without the tray, nothing prevents the child from toppling forward out of the chair.

BRIEF SUMMARY OF THE INVENTION

The highchair of this invention overcomes the foregoing inadequacies. According to this invention, a highchair is equipped with a play and food tray that is completely detachable, easily, and without the use of screws or other relatively permanent connections. The advantage of the detachable tray is that it does not constitute an obstacle in the event that the highchair is used as an ordinary chair against a table, or otherwise as a piece of children's furniture requiring no tray. Unlike many prior highchairs, without the chair in place, the chair of this invention restrains the child from falling forward out of the chair. Likewise, the chair restrains the child even if the tray somehow becomes detached during use.

A further advantage of the highchair according to the invention is the manner of attachment of the tray such that, in ordinary use, slight downward pressure on the upper surface of the tray acts to lock the tray in place. The tray includes rearwardly extending shafts. The shafts embrace the sides of the highchair and have, near the shaft ends, cooperating easily detachable means for locking the tray in place. These latter are projections and aligned holes that connect the shafts with the chair sides. Near the front of the chair, the chair sides provide arm supports. A bar extending from one arm support to the other and a cooperating recess on the tray provide means for securing the tray in place near the forward ends of the arm supports. The projections that are a part of the locking means that detachably connect the shafts to the chair sides have latching bosses or enlargements that fit about the ends of the cooperating holes. The cooperating recess and bar permit slight pivotal movement when downward pressure is applied to the upper tray surface, and this moves the bosses on the projections into latching engagement near the edges of the holes.

The shafts that extend rearwardly from the tray, embracing the sides of the chair, can be resilient and biased inward sufficiently to cause the projections to be located in the holes as soon as the projections and holes align. In addition to cooperating with the recess to form the aforesaid means for securing the tray in place, the bar extending horizontally between the arm support sections can provide structural strength to the chair, and can have the beneficial effect of restraining the child's forward movement, as discussed above.

BRIEF DESCRIPTION OF THE DRAWINGS

The above and further advantages of the invention will be more fully understood with reference to the following detailed description of a preferred embodiment of the invention, along with the several views of the attached drawings, wherein.

DESCRIPTION OF A PREFERRED EMBODIMENT

Figure 1:
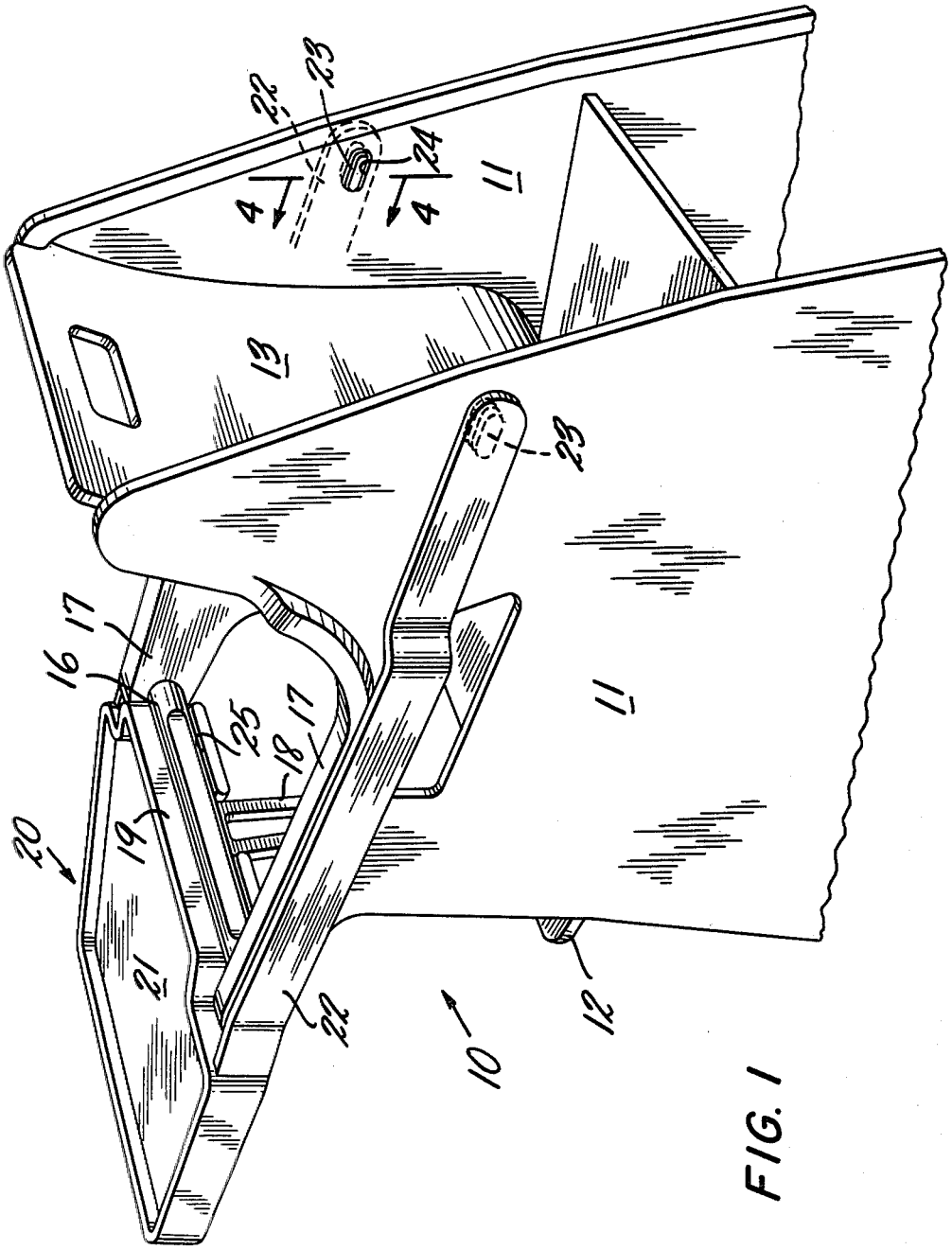
FIG. 1 is a fragmentary perspective view of an upper portion of a highchair with a detachable play and food tray, showing the tray secured in place for use with the chair.

Turning now to the drawings in detail, FIG. 1 shows a highchair 10 that has two sides 11 joined together by a seat 12 and a back support 13 attached to the seat. The sides 11 of the chair 10 provide arms or arm support sections 17, and a horizontally extending bar 16 connects these together. Like the seat 12 and back 13, the bar 16 also serves as a structural member that interconnects the sides 11 of the highchair. A vertically positioned support 18 connects the bar 16 to the seat 12.

Figure 2:
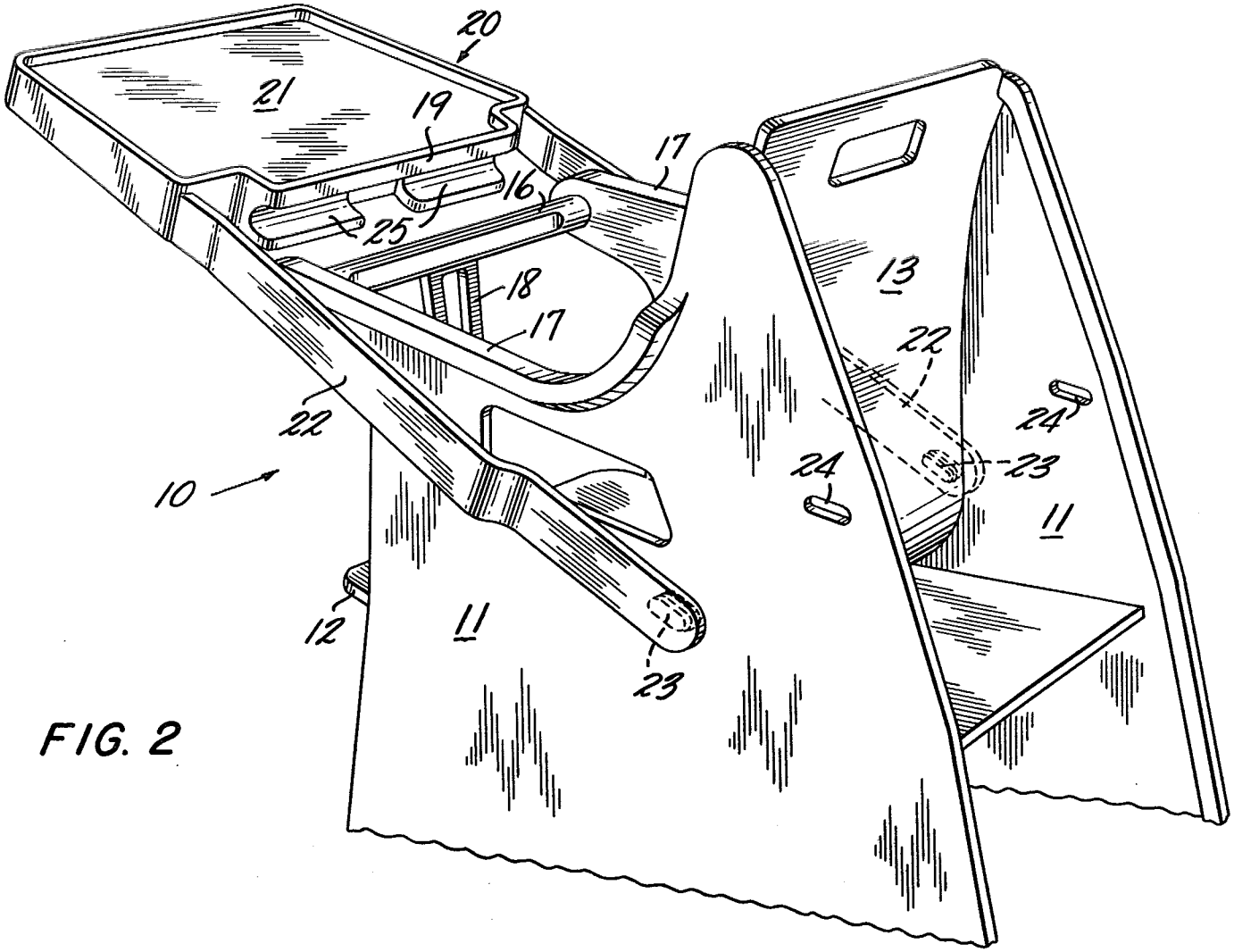
FIG. 2 is another fragmentary perspective view of the upper highchair portion of FIG. 1, illustrating detachment of the tray from the remainder of the highchair.

A play and food tray, generally designated 20, includes an upper play and food surface 21 and two rearward extending shafts 22. These shafts 22 can be arranged, as shown, as extensions of the two side edges of the tray, and can, if desired, be integrally formed with the remainder of the tray. A rear edge 19 of the tray provides a recess or recesses 25 between the shafts 22, as best seen in FIG. 2. The recesses 25 receive the bar 16 to locate and secure the tray in place at the forward ends of the arm support sections 17.

Figure 3:
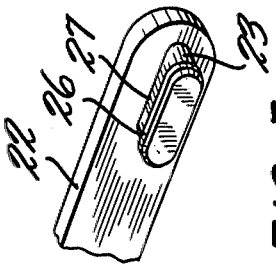
FIG. 3 is an enlarged fragmentary perspective view of a locking projection formed on the inner face of a rearward extending shaft on the tray.
Figure 4:
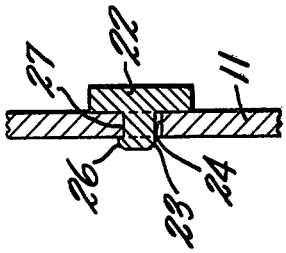
FIG. 4 is an enlarged fragmentary cross-section view along the lines 4—4 of FIG. 1, and illustrates the latching relationship of the projections and holes that lock together the shafts and chair sides to retain the tray in place.

Near the free ends of the shafts 22, which embrace the sides 11 of the chair, locking heels or projections 23 protrude inward from the internal faces of the shafts. When the tray is mounted on the chair, the projections 23 extend into a pair of holes 24 in the chair sides 11. The heels or projections 23 terminate in bosses 26 that latch against the inner surface of the chair sides 11 adjacent the upper edges of the holes 24 as shown in FIG. 4. The holes 24 are slightly larger than the projections 23 and the bosses 26 to provide free movement of the projections and bosses into the holes.

The attachment of the tray to the highchair proceeds as follows:

The tray is positioned in front of the bar 16, with the shafts 22 aligned on each side of the arms or arm support sections 17. When the recesses 25 on the rear edge of the tray clamp around the bar 16, the outer end of the shafts 22 are positioned so that the projections 23 slide into the holes 24 on the chair sides 11. To prevent the projections from sliding out of their location in the holes, the shafts 22 are spring tensioned or biased inward toward one another so that their outer ends press in on the sides 11, pressing the projections 23 fully into the holes 24. The width of an upper face 27 on each projection 23 between the boss 26 and the arm 22 is approximately the width of the chair side 11. When the play and food tray is so positioned and subjected to a load, by, for example, placement of food on the upper surface 21 or by the child's hands exerting normal downward forces during play, slight pivoting of the tray occurs to push the projections 24 upward until the surfaces 27 engage the upper surfaces of the respective holes and the bosses 26 latch about the interior ends of the holes 24.

As can be seen, the tray is securely locked in place in ordinary circumstances; yet it is simply and easily detachable completely from the remainder of the chair 10. With or without the tray, the bar 16 and vertical support 18 restrain the child from toppling forward or sliding out of the chair. As compared to the tray, these members are relatively permanently attached to the chair, by any convenient means such as screw fasteners, gluing or integral molding. The highchair, then, is useful as a conventional highchair with the play and food tray, or is safely and easily used without the tray. The bar 16 serves a structural function in its interconnection of the sides 11, it restrains the child, and it forms, with the recess or recesses 25, the pivotal securing means that permits the projections 23 slight upward movement in the holes 24 to lock the bosses 26 in latched relation to the chair sides 11. The projections and holes that form the locking means provide a screwless, connection that is easily attached or detached when desired, but difficult to detach accidentally.

Although the foregoing description and associated drawings of a preferred highchair embodiment set forth particularly advantageous structure, modifications of the preferred embodiment will be apparent to those skilled in the art, without departure from the spirit and scope of the invention, as defined in the appended claims.

I claim:

1. A highchair equipped with a play and food tray; the highchair comprising two vertical sides including forward arms, the sides having a seat and a seat back therebetween, said arms and said tray having cooperating means for securing the tray in place near the forward ends of the arms, said tray including two side extension shafts projecting rearward, and cooperating locking means on each of said sides and each of said shafts remote from the tray for detachably connecting said shafts to said sides when said tray is secured in place by said cooperating means for securing, said locking means for detachably connecting said shafts comprising projections and holes cooperating to connect the sides and the shafts, said holes receiving the projections when the tray is fitted into operative position on the highchair with said tray located by said cooperating means for securing the tray in place, and said shafts being resilient and biased inwardly toward each other when the shafts are in place adjacent the sides of the highchair, whereby said projections locate in said holes when the holes and projections are aligned.

2. The highchair according to claim 1, wherein said projections have bosses thereon located to latch said projections in said holes by engagement of adjacent surfaces at the edges of the holes.

3. The highchair according to claim 2, wherein said cooperating means for securing pivotally supports the tray on said arms, said tray having an upper play and food surface on the opposite side of the pivotal support location from the locking means, the tray, shafts, and bosses being of integral plastic construction, said shafts being spaced to fit along the outer sides of the chair sides, said projections and holes being locted near the ends of the shafts well rearward of the child location on the chair when the tray is in operative position, said bosses being located on the projections to move into interlocking engagement with said adjacent surfaces at the edges of the holes when the play and food surface of the tray is pivoted downwardly slightly with said projections in the holes.

4. A highchair equipped with a play and food tray; the highchair comprising two vertical sides including forward arms, the sides having a seat and a seat back therebetween, said arms and said tray having cooperating means for securing the tray in place near the forward ends of the arms, said tray including two side extension shafts projecting rearward, and cooperating locking means on each of said sides and each of said shafts remote from the tray for detachably connecting said shafts to said sides when said tray is secured in place by said cooperating means for securing which comprises an interfitting and laterally extending recess and bar, one of which is relatively permanently secured to the arm supports to remain on the chair when the tray is removed, and the other of which is on the tray.

5. The highchair according to any one of claims 1, 2, 3, or 4, wherein the cooperating means for securing the tray in place near the forward end of the arm supports comprises a bar extending horizontally between and interconnecting the arm supports and means defining an interfitting recess on the tray for receiving the bar when the tray is attached to the highchair, said bar being relatively permanently secured in place on said arms, and said tray being entirely detachable from said highchair by removal of said projections from said holes and removal of said recess from said bar, whereby said bar remains in place as a forward child support when said tray is detached from the highchair.

6. The highchair according to claim 4, wherein the sides extend rearward beyond the seat back and the holes and projections are located well rearward of the seat back with the tray in its operative position so as to be inaccessible from inside the child seat location.

* * * * *